US006533030B2

(12) United States Patent
Mitrovic et al.

(10) Patent No.: US 6,533,030 B2
(45) Date of Patent: Mar. 18, 2003

(54) HEAT TRANSFER PIPE WITH SPIRAL INTERNAL RIBS

(75) Inventors: Jovan Mitrovic, Steinenbronn (DE); Steffen Dittmann, Menden (DE); Michael Schönherr, Herscheid (DE)

(73) Assignee: F.W. Brokelmann Aluminiumwerk GmbH & Co. KG (DE)

( * ) Notice: Subject to any disclaimer, the term of this patent is extended or adjusted under 35 U.S.C. 154(b) by 0 days.

(21) Appl. No.: 09/911,248

(22) Filed: Jul. 23, 2001

(65) Prior Publication Data

US 2002/0014328 A1 Feb. 7, 2002

(30) Foreign Application Priority Data

Aug. 3, 2000 (DE) ..... 100 38 624

(51) Int. Cl.[7] ..... F28F 1/14

(52) U.S. Cl. ..... 165/184; 165/DIG. 524; 165/179; 138/38

(58) Field of Search ..... 165/177, 179, 165/133, 184; 29/890.049; 138/38

(56) References Cited

U.S. PATENT DOCUMENTS

| | | | | | |
|---|---|---|---|---|---|
| 1,519,673 | A | * | 12/1924 | Doble | 138/38 |
| 1,881,610 | A | * | 10/1932 | Hyde | 165/179 |
| 2,463,997 | A | * | 3/1949 | Rodgers | 138/38 |
| 2,731,709 | A | * | 1/1956 | Gaddis et al. | 165/177 |
| 2,930,405 | A | * | 3/1960 | Welsh | 165/177 |
| 3,267,564 | A | * | 8/1966 | Keyes | 165/179 |
| 3,528,494 | A | * | 9/1970 | Levedhal | 165/104.26 |
| 3,705,617 | A | * | 12/1972 | Miller et al. | 165/179 |
| 4,154,296 | A | * | 5/1979 | Fijas | 165/179 |
| 4,332,294 | A | * | 6/1982 | Drefahl et al. | 165/177 |
| 5,655,599 | A | | 8/1997 | Kasprzyk | 165/133 |

FOREIGN PATENT DOCUMENTS

| | | | |
|---|---|---|---|
| DE | 24 02 942 | 7/1974 | F24H/3/06 |
| DE | 74 22 107 | 9/1974 | F28F/1/36 |
| DE | 26 15 168 | 10/1977 | F28F/1/16 |
| DE | 27 03 341 C2 | 1/1983 | B21C/25/04 |
| DE | 33 34 964 A1 | 4/1985 | F28F/1/10 |
| DE | 196 09 641 | 5/1999 | F24F/5/00 |
| EP | 0 582 835 A1 | 2/1994 | F28F/1/04 |
| EP | 0 591 094 A1 | 4/1994 | F28F/1/40 |
| EP | 0 692 693 A2 | 1/1996 | F28F/1/40 |
| WO | WO 96/12151 | 4/1996 | F28F/1/40 |

* cited by examiner

*Primary Examiner*—Henry Bennett
*Assistant Examiner*—Terrell McKinnon
(74) *Attorney, Agent, or Firm*—Renner, Kenner, Greive, Bobak, Taylor & Weber

(57) ABSTRACT

This invention relates to a pipe (1) having several internal ribs (2, 3, 4) having a spiral twist, where the ribs run with rotational symmetry with the longitudinal axis (5) of symmetry of the pipe (1).

This invention creates a heat transfer pipe that will be characterized by a much better heat transfer in comparison with the previously known pipes having internal ribs, and to this end it guarantees not only an increase in the internal heat transfer surface area but also an effective cross-flow between the inside wall surface of the pipe and the core flow near the longitudinal axis of symmetry. To that end, the free ends (2*c*, 3*c*, 4*c*) of the internal ribs (2, 3, 4) are a distance (a) from the longitudinal axis (5) of symmetry of the pipe (1), which is in the range of 1:12 to 1:3 in relation to the inside diameter (d) of the pipe; and all the internal ribs (2, 3, 4) run in the same direction (arrow 6) and with the same spiral length (L) with a spiral twist to the longitudinal axis (5) of symmetry.

11 Claims, 3 Drawing Sheets

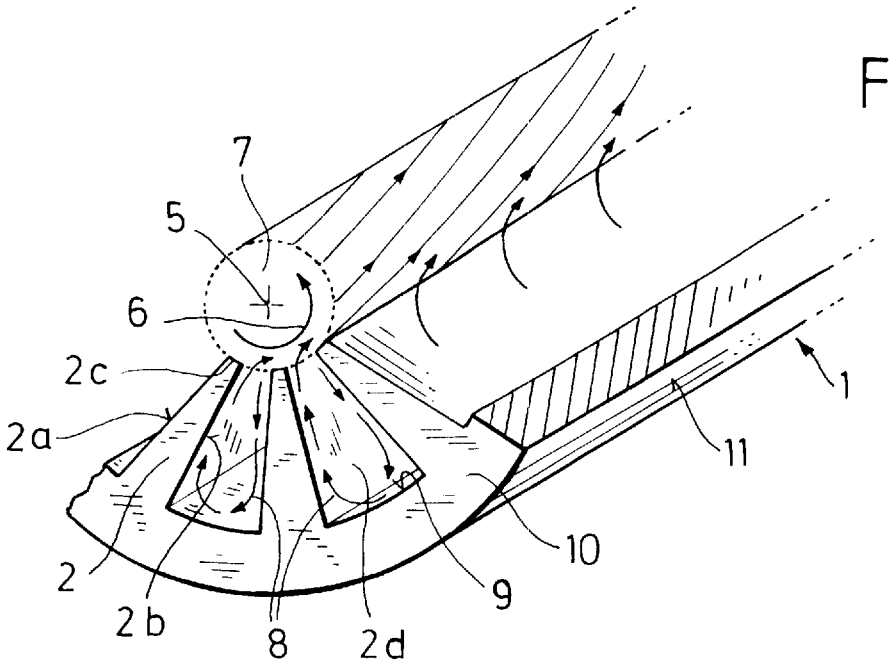
Fig. 5
Fig. 6
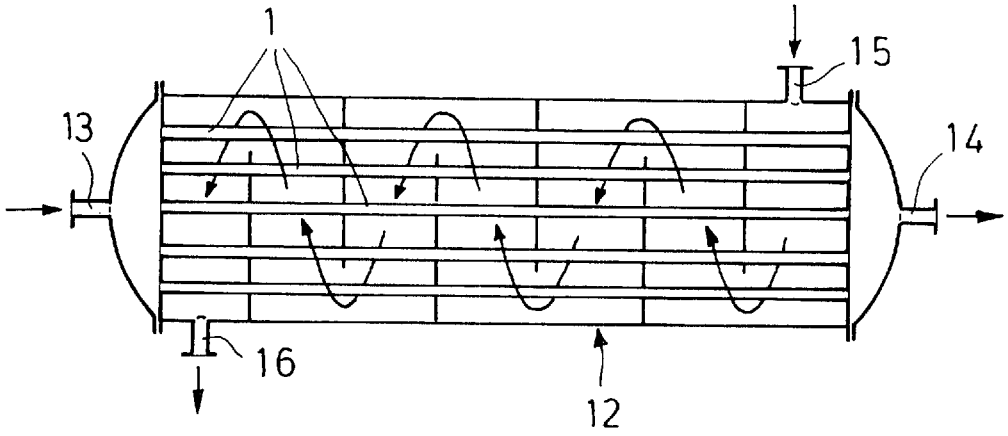

HEAT TRANSFER PIPE WITH SPIRAL INTERNAL RIBS

TECHNICAL FIELD

This invention relates to a pipe with spiral internal ribs which run with rotational symmetry with the longitudinal axis of symmetry of the pipe.

BACKGROUND ART

A known pipe of this type which is described according to German Utility Model No. 74 22 107 has several multiple-thread screw-like internal ribs on its inside, having a small width b and a small radial height e. The width b should be in the range of 0.02 to 0.15 inch and the height e should be in the range between 0.0125 and 0.075 inch; i.e., under the assumption that 1 inch=25.4 mm, the greatest extent in both dimensions should be a width b of 3.8 mm, a height e of 1.9 mm and an inside diameter of approximately 20.3 mm. It follows from this that turbulence which promotes heat transfer will develop in the vicinity of the inside wall in such a pipe through which a fluid is flowing because of the ratio of the inside diameter of the pipe to the relatively short inside ribs which are designed to be like nubs in cross section, but there is no secondary flow across the main direction of flow, and thus ultimately the heat transfer effect remains limited to the main flow conditions and the turbulence caused by irregularities in the wall.

The inventor of German Patent No. 196 09 641 C2 which pertains to a different generic field has recognized this disadvantage of the heat transfer surface of the internal ribs being too low and to this end proposed a pipe for cooling concrete floors with air, said pipe being provided with much longer, straight internal ribs which extend radially from the inside wall of the pipe in the direction of the longitudinal axis of symmetry. However, this pipe has the disadvantage that core flow, i.e., flow through the free central space near the longitudinal axis of symmetry, is subject to a considerable pressure drop, and effective heat transfer between this core flow and the inside wall of the pipe is left up to chance because there is no flow across the main direction of flow which would increase the heat transfer. Because of wall friction, the flow within each of two adjacent rib flanks and the partial chamber formed by the rib flanks and the inside wall of the pipe has a lower velocity than the core flow. Furthermore, the mass exchange between the core flow and the flow in the individual chambers is left up to chance. Since these ribs lower the heat transfer coefficient due to the reduced rate of flow in the chambers, their positive effect is based exclusively on the fact that they increase the heat transfer area. The same thing also applies to the pipe according to FIG. 2 of German Patent 27 03 341 C2, which is of a different generic type.

In addition, European Patent No. 0 582 835 A1 describes a heat transfer device which is composed of several pipes of a different generic type, where the outside walls are graduated, and additional pipes with different dimensions and inside ribs in various configurations are arranged concentrically in the interior to serve as an oil cooler. These heat transfer pipes have the disadvantage of a considerable pressure drop, in addition to the fact that they are expensive to manufacture, because there is little or no cross-flow, which could increase the heat transfer, or such cross-flow can develop only randomly and remains limited to the internal pipe.

In addition to the publications mentioned above, there is also an extensive state of the art pertaining to pipes having internal ribs as described, for example, in Unexamined German Patent No. 24 02 942, German Patent No. 33 34 964 A1 and Unexamined German Patent No. 26 15 168, all of which concern internal ribs having the disadvantages explained above. Since there is no spiral twist to these ribs, they also do not conform to the generic type of the pipes described in the present invention.

DISCLOSURE OF THE INVENTION

The object of the present invention is to create a heat transfer pipe of the generic type defined in the preamble, which is characterized by a much better heat transfer performance in comparison with the pipes having internal ribs known in the past, and to this end it not only causes an increase in the internal heat transfer area but also guarantees an effective cross-current between the inside wall surface of the pipe and the core flow in the vicinity of the longitudinal axis of symmetry to increase the heat transfer.

This object is achieved by the following features according to this invention in conjunction with the generic term described in the preamble:

a) The free ends of the internal ribs are the same distance a from the longitudinal axis of symmetry of the pipe, said distance a being in a ratio in the range of 1:12 to 1:3 relative to the inside diameter d of the pipe b) All the inside ribs run in a spiral twist in the same direction and with the same length of the spiral relative to the longitudinal axis of symmetry.

Due to these features, a pipe is created for the first time which not only has a large heat transfer area on its inside due to the small distance a between 1/12 and 1/3 of the inside diameter of the pipe, but also a cross-flow with a relatively low pressure drop develops, thus ensuring a considerable increase in the heat transfer effect between the core flow and the wall of the pipe, said cross-flow developing due to the spiral twist of the inside ribs in each spiral twisted interspace between two adjacent rib flanks and the pipe wall on the one hand and the core flow on the other hand flowing through the free space near the longitudinal axis of symmetry. This active principle does not have any precursor in the entire state of the art, whether because no marked cross-flow can develop due to the short nubby ribs according to the most proximate state of the art as described in German Utility Model No. 74 22 107, but instead only an increased turbulence can develop in the wall area, or whether it is because of the fact that the longer ribs according to the state of the art do not do not have any spiral twist.

In the design of the cross-sectional shape of the inside ribs, this invention permits several embodiments.

According to a first embodiment, the cross-sectional shape of each rib forms an acute equilateral triangle with straight legs, with the tip of the triangle developing into the two legs in a rounded form with a radius, where two adjacent internal ribs form an interspace having a trapezoidal cross section. Although this cross-sectional shape is basically known from German Patent No. 33 34 964 A1, the ribs there do not have a spiral twist, so they cannot be regarded as known in combination with the spiral twist features of claim 1.

According to a second embodiment, the cross-sectional shape of each internal rib of the pipe is in the form of a tooth with toothed wheels having flanks with an outward convex curvature and with the tips of the teeth being rounded, with two adjacent ribs forming an interspace having a U-shaped cross section with the side faces having a concave curvature. This rib shape is especially suitable for high-viscosity fluids such as oils.

According to a third embodiment, the cross-sectional shape of each internal rib forms an equilateral acute triangle with legs that form a concave inward curvature and a semicircular shape at the tip, where two adjacent internal ribs surround in a U shape an interspace having a trapezoidal cross section, the trapezoid legs having a convex outward curvature. This rib shape is preferably used with low-viscosity fluid flow such as gases.

All these different embodiments of the internal ribs lead to different flow patterns across the core flow in the area of the longitudinal axis of symmetry. The number of ribs, the pitch of the twist, the rib thickness and their shape are designed as a function of the type of fluid and its rate of flow as well as the pressure drop without thereby going beyond the scope of this invention.

According to an especially advantageous refinement of this invention, these pipes are mass produced with their internal ribs made of extruded aluminum or copper or extruded plastic. Both aluminum and copper are characterized by a high thermal conductivity.

To ensure a uniform core flow and cross-flow, the cross-sectional shape of the pipe with its internal ribs and the interspaces is the same over the entire length of the twist in each cross-sectional level.

The wall thickness of the pipe is determined as a function of the system pressure and is advantageously in a range between 0.4 mm and 3 mm, with each pipe having at least four internal ribs.

To obtain the greatest possible heat transfer effect with a relatively low pressure drop, the distance a of the free ends of the internal ribs from the longitudinal axis of symmetry of the pipe is greater in the case of high-viscosity fluids such as oils and is lower in the case of lower-viscosity fluids such as water and gases. This causes an increase in the cross section of the core flow in the area of the free cross section in the vicinity of the longitudinal axis of symmetry in the case of high-viscosity fluids in comparison with low-viscosity fluids.

According to this invention, the free interior in the vicinity of the longitudinal axis of symmetry in each pipe may by no means be closed. This space must communicate with the channels between the ribs. For this reason, in an advantageous refinement, the free ends of the internal ribs are always a distance a away from the longitudinal axis of symmetry, even in the case of low-viscosity fluids, so that a core flow channel is maintained between its free ends in each cross section of the pipe. For this reason, according to feature a of the main claim, this distance a is no less than 1/12 the inside diameter of the pipe.

BRIEF DESCRIPTION OF THE DRAWINGS

Several embodiments of this invention are illustrated in the drawings, which show:

FIG. 5: the pipe from FIG. 4 in a partially cut-away perspective view with the direction of flow indicated by arrows, and FIG. 6: an example of a schematic diagram of a heat transfer device for use of the pipes according to FIGS. 1 through 5.

PREFERRED EMBODIMENT FOR CARRYING OUT THE INVENTION

Figure 1:
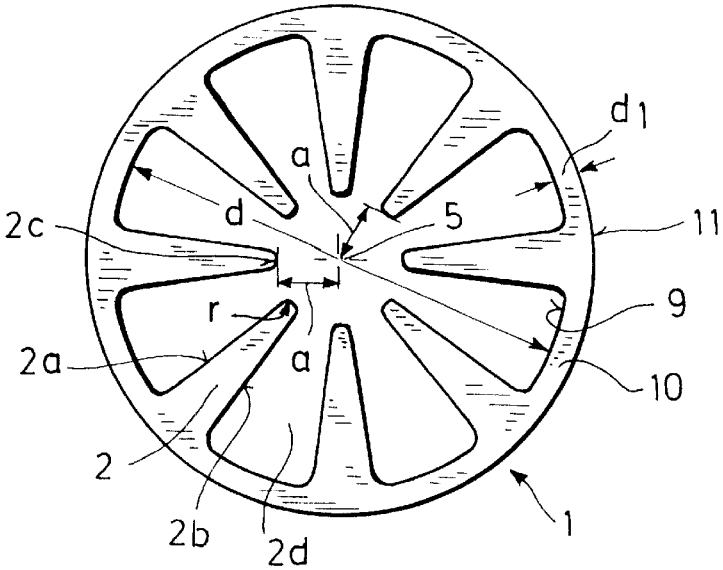
FIG. 1: the cross section through a pipe having eight internal ribs which have the cross-sectional shape of an acute equilateral triangle.

FIG. 1 illustrates a first embodiment of the pipe 1 according to this invention, where the cross-sectional shape of each rib 2 forms an acute equilateral triangle with straight legs to 2*a*, 2*b* whose triangular tip 2*c* develops into the two legs 2*a*, 2*b* by way of a radius r so that it is rounded. Two adjacent internal ribs 2 form an interspace 2*d* having a trapezoidal cross section.

Figure 2:
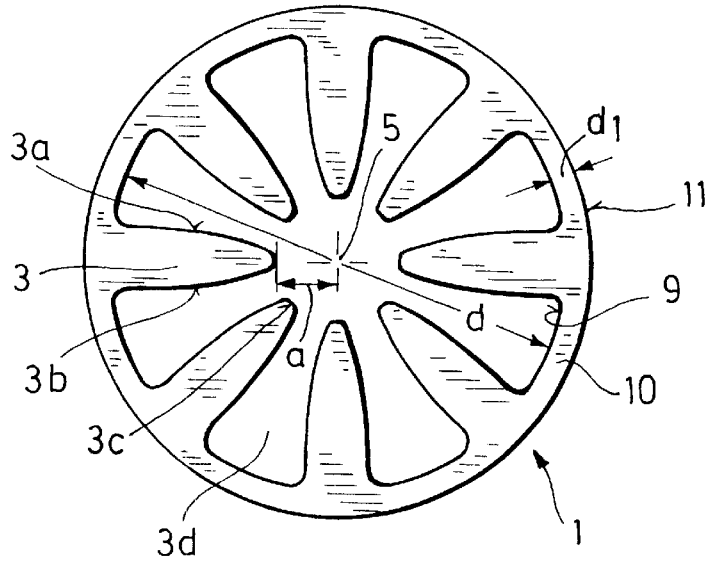
FIG. 2: another cross-sectional design of a pipe having internal ribs, each of which has the cross-sectional shape of a tooth in the case of toothed wheels with flanks having an outward convex curvature.

In the embodiment shown in FIG. 2, each internal rib 3 of the pipe 1 is in the shape of a tooth of a gear wheel with side flanks 3*a*, 3*b* having an outward convex curvature and rounded tip 3*c* of the tooth. Two adjacent ribs 3 extend around an interspace 3*d* having a U-shaped cross section with side faces with a convex curvature which are identical to the shape of the side flanks 3*a*, 3*b* of ribs 3.

Figure 3:
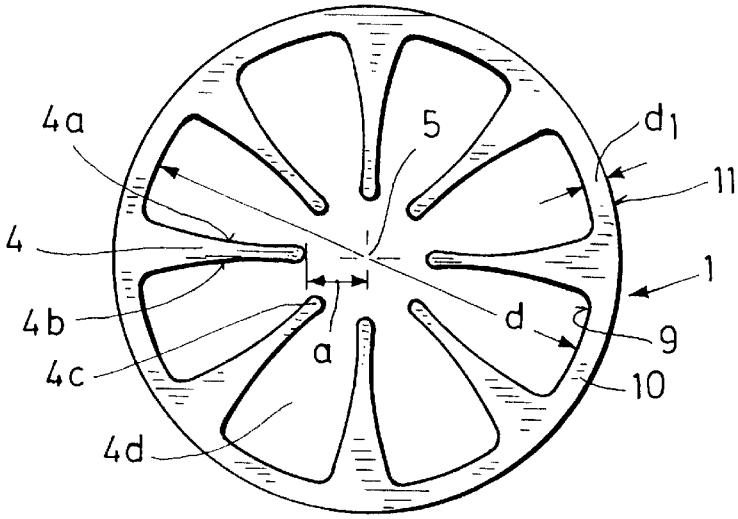
FIG. 3: a third cross-sectional shape of a pipe, where each internal rib has the cross-sectional shape of an acute equilateral triangle with its legs having an inward concave curvature.

FIG. 3 discloses another cross-sectional shape, where the cross section of each internal rib 4 forms an acute equilateral triangle with legs 4*a*, 4*b* having a concave inward curvature with a semicircular tip 4*c*. Two adjacent internal ribs 4 extend in a U-shape around an interspace 4*d* having a trapezoidal cross section, its trapezoidal legs having an outward convex curvature and being identical to legs 4*a*, 4*b*.

Each pipe 1 is provided with at least four internal ribs 2, 3, 4, namely in the present case eight internal ribs 2, 3, 4 each. The free ends 2*c*, 3*c*, 4*c* are identical to the tips of the cross-sectional shapes of the individual internal ribs 2, 3, 4. However, it must be recalled here that the tips are based on the flat cross-sectional body of a triangle, whereas the free ends are based on a three-dimensional body having a twist relative to the longitudinal axis 5 of symmetry. These free ends 2*c*, 3*c*, 4*c* are a distance a from the longitudinal axis 5 of symmetry of the pipe 1, said distance being in the range of 1:12 to 1:3 in relation to the inside diameter d of the pipe.

Figure 4:
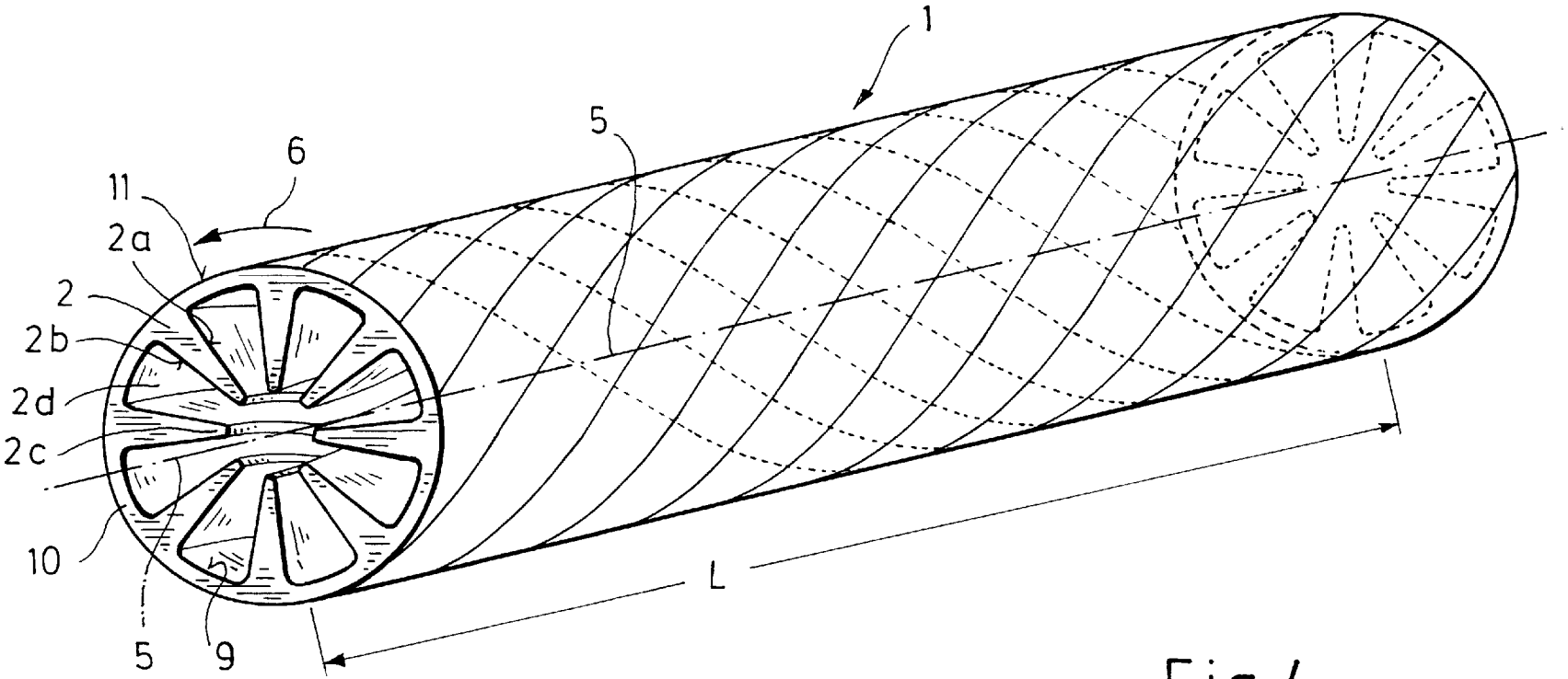
FIG. 4: a perspective view of the pipe from FIG. 1 with the spiral twist of the internal ribs indicated with dotted lines.

Finally, according to the perspective view in FIG. 4, all the internal ribs 2, 3, 4 run in a spiral twist in the same direction relative to the longitudinal axis 5 of symmetry, e.g., to the left in the direction of arrow 6 here, and they have the same spiral length L. This spiral length is understood to refer to the length between a complete 360° twist of a rib, i.e., the length L between two sectional planes between which each rib is in the same location in the first plane of intersection after a 360° C. twist.

The pipes are produced to advantage either from extruded aluminum or copper or extruded plastic.

The wall thickness $d_1$ of pipe 1 depends on the system pressure and is in the range between 0.4 mm and 3 mm.

To prevent any irregularity in flow, the cross-sectional configuration of pipe 1 with its internal ribs 2, 3, 4 and the interspaces 2*d*, 3*d*, 4*d* is the same in each cross section over the length L of the spiral twist. This suppresses any sudden changes in pressure and unwanted interfering effects, so that the core flow 7 and any cross-flow 8 communicate with one another in the interspaces 2*d*, 3*d*, and 4*d*, and there is a mutual exchange.

It is self-evident that the pipes 1 may also consist of pipes other than those illustrated in FIGS. 1 through 3, so that instead of the eight ribs 2, 3, 4 shown there, only four ribs 2, 3, 4 or more than eight ribs may also be arranged in the interior of the pipe 1. The number of ribs 2, 3, 4, the length L of the spiral twist and the thickness and shape of the ribs are determined as a function of the type of fluid and its flow rate as well as the pressure drop. The general rule of flow holds, namely that the pressure drop is greater, the narrower the free cross section of flow in the core area and between the individual ribs 2, 3, 4, but on the other hand, there is a passive increase in the heat transfer effect with a larger number of ribs and thus also a larger heat transfer area.

This is of crucial importance in the case of the pipe 1 according to this invention, however, and the cross-flow induced by it between the core area near the longitudinal axis 5 of symmetry and the inside wall 9 of the pipe. This is illustrated in FIG. 5. Around the longitudinal axis 5 of symmetry of the pipe 1, a core flow 7 develops in the free flow cross section between the ends 2*c*, 3*c*, 4*c* of the ribs 2, 3, 4, and this core flow also develops a twist because of the twist in the end areas corresponding to the ends of the tips 2*c*, 3*c*, 4*c*, which in the case illustrated here is a left-handed twist, i.e., it is associated with counterclockwise rotation in the plane of the figure as indicated by arrow 6 in FIGS. 4 and 5. Because of the twist of ribs 2 and 3, 4, a cross-flow 8 develops in the interspaces 2*d* and 3*d*, 4*d*, as indicated by the arrows shown there. Due to this cross-flow 8 i.e., due to flow across the longitudinal axis 5 of symmetry, there is an extremely intense heat transfer between the core flow 7 and the inside wall 9 of the pipe 1. There is a considerable heat transfer effect from the core flow 7 through the cross-flow 8 to the inside 9 of the pipe 1, and from there heat is transferred further through its wall 10 with the thickness $d_1$ to the outside 11 due to the high thermal conductivity $\lambda$ of the pipe 1 which is manufactured of extruded aluminum or copper, for example, namely:

209.3 W/(mK) aluminum and 407.1 W/mK in the case of copper.

Such a pipe 1 is used, for example, in a pipe bundle heat transfer device 12 such as that illustrated in FIG. 6, where the cooling medium enters the pipes 1 through connection 13 and leaves the pipes through the outlet 14, for example. The medium to be cooled goes in countercurrent through the inlet connection 15 to the outside 11 of the pipes 1, leaving the heat transfer device 12 through the outlet connection 16 after being cooled. It is self-evident that the pipe 1 according to this invention can be used for cooling and for heating fluids, depending on the direction in which the heat transfer operation is to take place. The general rule holds that in the case of high-viscosity fluids such as oils, the distance a of the free ends 2*c*, 3*c*, 4*c* of the internal ribs 2, 3, 4 from the longitudinal axis 5 of symmetry of the pipe 1 is greater than that in the case of low-viscosity fluids such as water and gases.

What is claimed is:

1. A pipe having several internal ribs with a spiral twist running with rotational symmetry with the longitudinal axis of symmetry of the pipe, characterized by following features:

a) the free ends of the internal ribs are a distance from the longitudinal axis of symmetry of the pipe, which is in the range of 1:12 to 1:3 in relation to the inside diameter of the pipe;

b) all the internal ribs run in the same direction and with the same spiral length with a spiral twist to the longitudinal axis of symmetry;

c) the space between two ribs widens like a trapezoid from the free end of the ribs to the inside of the pipe; and d) the cross-section of each rib decreases continuously in width from the inside of the pipe to the free end of the rib.

2. The pipe according to claim 1, characterized in that the pipe with its internal ribs is made of extruded aluminum or copper or extruded plastic in one piece.

3. The pipe according to claim 1, characterized in that the cross-sectional configuration of the pipe with its internal ribs and the interspaces is the same over the length of the twist in each cross-sectional plane.

4. The pipe according to claim 1, characterized in that the wall thickness of the pipe is between 0.4 mm and 3 mm, depending on the system pressure.

5. The pipe according to claim 1, characterized in that the pipe has at least four internal ribs.

6. The pipe according to claim 1, characterized in that the free ends of the internal ribs are always a distance from the longitudinal axis of symmetry even with low-viscosity fluids, such that a core flow channel is formed between its free ends in each cross-sectional level of the pipe.

7. A pipe having several internal ribs with a spiral twist running with rotational symmetry with the longitudinal axis of symmetry of the pipe, characterized by following features:

a) the free ends of the internal ribs are a distance from the longitudinal axis of symmetry of the pipe, which is in the range of 1:12 to 1:3 in relation to the inside diameter of the pipe;

b) all the internal ribs run in the same direction and with the same spiral length with a spiral twist to the longitudinal axis of symmetry; and c) the cross-sectional shape of each internal rib forms an acute equilateral triangle with straight legs whose triangular tip develops into the two legs with a rounded tip because of radius, with two adjacent internal ribs forming an interspace having a trapezoidal cross section.

8. A pipe having several internal ribs with a spiral twist running with rotational symmetry with the longitudinal axis of symmetry of the pipe, characterized by following features:

a) the free ends of the internal ribs are a distance from the longitudinal axis of symmetry of the pipe, which is in the range of 1:12 to 1:3 in relation to the inside diameter of the pipe;

b) all the internal ribs run in the same direction and with the same spiral length with a spiral twist to the longitudinal axis of symmetry; and c) the cross-sectional shape of each internal rib of the pipe has the shape of the tooth of gear wheels with side flanks with a convex outward curvature and with a rounded tip of the tooth, and two adjacent ribs extend around an interspace having a U-shaped cross section with side faces having a concave curvature.

9. A pipe having several internal ribs with a spiral twist running with rotational symmetry with the longitudinal axis of symmetry of the pipe, characterized by following features:

a) the free ends of the internal ribs are a distance from the longitudinal axis of symmetry of the pipe, which is in the range of 1:12 to 1:3 in relation to the inside diameter of the pipe;

b) all the internal ribs run in the same direction and with the same spiral length with a spiral twist to the longitudinal axis of symmetry; and c) the cross-sectional shape of each internal rib has an acute equilateral triangle with legs having a concave inward curvature and a semicircular shape at the tip, with two adjacent internal ribs extending in a U-shape around an interspace having a trapezoidal cross section, the trapezoidal legs having an outward convex curvature.

10. A pipe having several internal ribs with a spiral twist running with rotational symmetry with the longitudinal axis of symmetry of the pipe, characterized by following features:

a) the free ends of the internal ribs are a distance from the longitudinal axis of symmetry of the pipe, which is in the range of 1:12 to 1:3 in relation to the inside diameter of the pipe;

b) all the internal ribs run in the same direction and with the same spiral length with a spiral twist to the longitudinal axis of symmetry; and c) the number of ribs, the length of the twist, the thickness and the shape of the ribs are selected as a function of the type of fluid and its flow rate as well as the pressure drop.

11. A pipe having several internal ribs with a spiral twist running with rotational symmetry with the longitudinal axis of symmetry of the pipe, characterized by following features:

a) the free ends of the internal ribs are a distance from the longitudinal axis of symmetry of the pipe, which is in the range of 1:12 to 1:3 in relation to the inside diameter of the pipe;

b) all the internal ribs run in the same direction and with the same spiral length with a spiral twist to the longitudinal axis of symmetry; and c) the distance of the free ends of the internal ribs from the longitudinal axis of symmetry of the pipe is selected to be larger in the case of high-viscosity fluids such as oils than in the case of low-viscosity fluids such as water and gases.

* * * * *